United States Patent [19]

Dale et al.

[11] Patent Number: 4,618,198

[45] Date of Patent: Oct. 21, 1986

[54] CONNECTOR FOR SEALINGLY JOINING THE ENDS OF A PAIR OF ELECTRICAL CABLES

[75] Inventors: Steven M. Dale, Williamsville; Richard A. Lyon, Buffalo; David P. Schutram, West Seneca, all of N.Y.

[73] Assignee: Conax Buffalo Corporation, Buffalo, N.Y.

[21] Appl. No.: 594,576

[22] Filed: Mar. 29, 1984

[51] Int. Cl.[4] ..... H01R 13/506; H01R 13/52

[52] U.S. Cl. ..... 339/60 M; 285/334.4

[58] Field of Search ..... 339/59 R, 59 M, 60 R, 339/60 M, 62, 63 R, 63 M, 94 R, 94 M, 136 R, 136 M, 143 R; 277/236, 112; 285/334.4

[56] References Cited

U.S. PATENT DOCUMENTS

| | | | |
|---|---|---|---|
| 1,522,374 | 1/1925 | Komori | 277/236 |
| 1,840,312 | 1/1932 | Dunmire | 277/236 |
| 2,563,762 | 8/1951 | Uline et al. | 339/63 M |
| 2,568,232 | 9/1951 | Hamer | 285/334.4 |
| 2,903,281 | 9/1959 | Avery | 277/236 |
| 3,264,012 | 8/1966 | Giovanazzi et al. | 285/334.4 |
| 3,471,826 | 10/1969 | Hutter et al. | 339/94 R |
| 3,576,517 | 4/1971 | Johnson et al. | 339/94 R |
| 3,789,346 | 1/1974 | De Brick | 339/94 R |
| 4,158,473 | 6/1979 | Shearer | 339/63 M |
| 4,447,104 | 5/1984 | Haggard | 339/94 M |

FOREIGN PATENT DOCUMENTS

| | | | |
|---|---|---|---|
| 496385 | 12/1975 | U.S.S.R. | 285/334.4 |
| 655870 | 4/1979 | U.S.S.R. | 285/334.4 |

*Primary Examiner*—Neil Abrams

*Attorney, Agent, or Firm*—Sommer & Sommer

[57] ABSTRACT

A connector for sealingly joining the ends of a pair of electrical cables which provides a reusable quick-disconnect metal-to-metal sealing joint. Without the use of elastomeric seals. The connector has a male housing encircling the marginal end portion of one cable, has a female housing encircling the marginal end portion of the other cable, and has a coupling for selectively drawing the two housings into sealing engagement with one another. Each housing is sealed to the outer surface of the associated cable. An insert, provided with a flexible tab, is snapped into each housing to maintain the spacing of the conductors from one another and from the housing.

6 Claims, 20 Drawing Figures

M2
302
145
144
342
141
142
143
CL2
212
222
CR2
232
242
148
147
146
149
402
150
352
F2
C2

CONNECTOR FOR SEALINGLY JOINING THE ENDS OF A PAIR OF ELECTRICAL CABLES

This invention relates to a connector for sealingly joining the ends of a pair of electrical cables.

As is well known, a mineral-insulated metal sheath cable comprises at least one electrical conductor, such as a metal wire, surrounded by compacted mineral insulation, such as magnesium oxide, and enclosed in a protective metal sheath, such as stainless steel. While such compacted magnesium oxide has high insulation properties, it is hygroscopic and therefore must be kept dry in order to protect the integrity of its insulative property.

The present invention is concerned, in one of its applications, with means for sealing the moisture-sensitive end face of two separate mineral-insulated metal sheath cables which are cut back to expose a length of their conductors for electrical connection.

There are known connectors for mineral-insulated metal-sheath cables which employ bodies of organic or elastomeric material to seal the joint necessarily formed when the components of the connector are brought together. The use of such organic or elastomeric material has disadvantages, especially where the connector is used in a harsh environment, such as obtains in a nuclear reactor. For example, an elevated temperature shortens the effective life of the organic or elastomeric material, causing a loss of sealing integrity. Also, exposure to nuclear radiation causes degradation of the resilience of organic or elastomeric material. Further, chemical spray used to neutralize radiation contamination and temperature can cause deterioration of organic or elastomeric material.

These disadvantages are avoided by the present invention which eliminates use of organic or elastomeric sealing material at the joint between the cables joined and provides a metal-to-metal sealing interface between component parts of the inventive connector when coupled.

Accordingly, an important object of the present invention is to provide a connector for sealingly joining the ends of two mineral-insulated metal-sheath cables, so that their electrical conductors can be electrically connected in a sealed environment enclosed by structure including only metal-to-metal joints. In other words, the end portions of the cables are encapsulated by an all-metal enclosure so that the end faces of the necessarily exposed mineral insulation within the enclosure are rendered mositure-proof durably.

Another object is to provide such a connector which can be used readily in the field to retrofit the connector to an already installed mineral-insulated metalsheath cable, as where such cable has been broken and the ends of the same are to be connected, or to replace another type of connector with the inventive connector.

Another important object of the present invention is to provide a connector for joining a pair of electrical cables, even other than the mineral-insulated metal-sheath type, which provides a metal-to-metal sealing joint and can be quickly disconnected and reconnected when desired by the use of simple tools, such as wrenches.

A still further object is to provide such a connector which is suitable for use in a high pressure environment.

Other objects of the present invention are to provide such a connector which is relatively simple in construction, easy to manufacture, easy to assemble, relatively inexpensive, and has an extremely high and durable sealing efficiency.

SUMMARY OF THE INVENTION

The connector of the present invention is intended for sealingly joining the ends of a pair of electrical cables, each having at least one insulated conductor, comprising a tubular metal male housing having inner and outer ends and associated with one of said cables, an external tapered surface on said inner end of said male housing, a tubular metal female housing having inner and outer ends and associated with the other of said cables, an internal tapered surface on said female housing and adapted to be contacted by said external tapered surface, means arranged to draw said housings together and force said tapered surfaces into firm contact to provide a sealed metal-to-metal joint, a contact pin member insulatively mounted in one of said housings and electrically connected to the conductor in the cable associated with such housing, a socket member insulatively mounted in the other of said housings and electrically connected to the conductor in the cable associated with such housing and adapted to receive said pin member, and means sealing the outer end of each of said housings to its associated cable.

Other objects and advantages of the present invention will be apparent from the several embodiments illustrated in the accompanying drawings.

DESCRIPTION OF THE PREFERRED EMBODIMENTS

FIGS. 1-15

Figure 15:
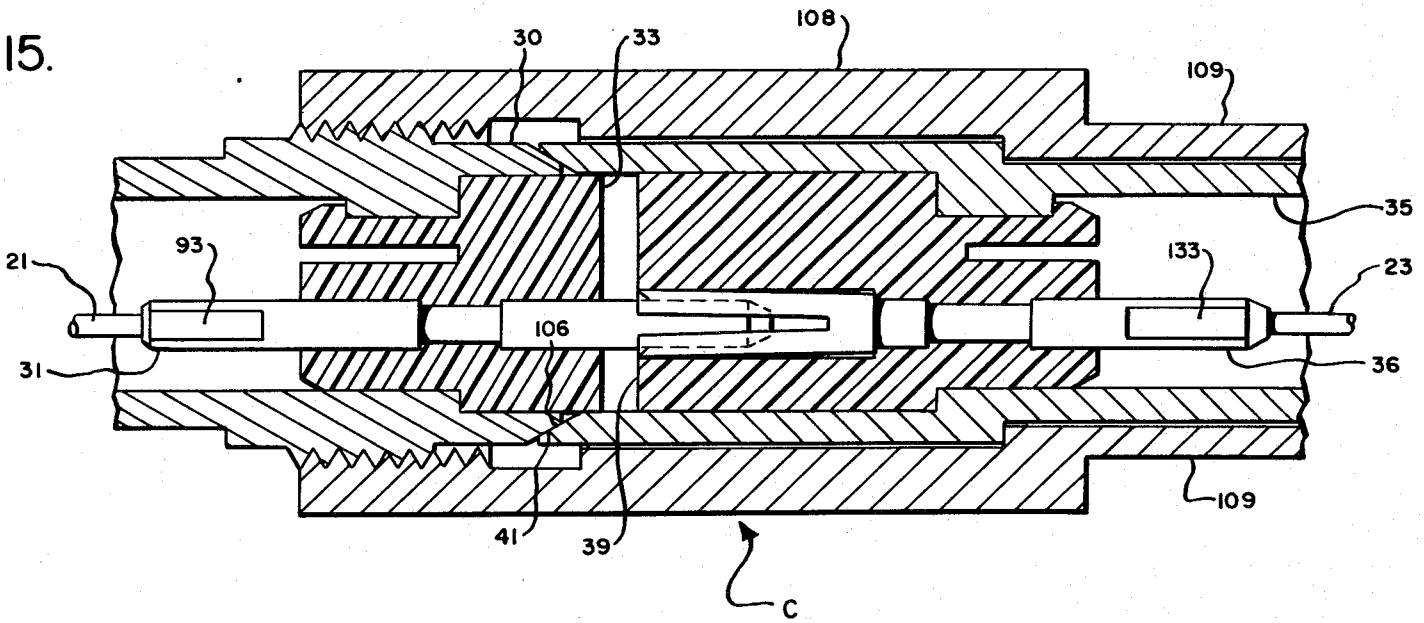
FIG. 15 is an enlarged fragmentary longitudinal sectional view of the male and female subassemblies shown in FIGS. 4 and 11 connected together in operative fully engaged condition.

The inventive connector C shown in FIG. 15 has two parts including a male subassembly M, separately illustrated in FIGS. 1-7, and a female subassembly F, separately illustrated in FIG. 8-14. The purpose of connector C is to sealingly join the ends of a pair of mineral-insulated metal-sheath cables of the same outside diameter, the left cable $C_L$ being associated with male subassembly M and the right cable $C_R$ being associated with female subassembly F. Each of cables $C_L$ and $C_R$ is shown as having at least one insulated conductor, and the same number for each. Two, 21 and 22, are illustrated for cable $C_L$, and two, 23 and 24, are illustrated for cable $C_R$. As is well known for mineral-insulated metal-sheath cable, conductors 21 and 22 of left cable $C_L$ are embedded in a body of compacted magnesium oxide 25 spaced from each other and surrounded by a metal sheath 26, and, similarly, conductors 23 and 24 of right cable $C_R$ are embedded in a body of compacted magnesium oxide 28 spaced from each other and surrounded by a metal sheath 29.

Referring to FIGS. 1-7, male subassembly M is shown as comprising a tubular metal male housing member 30, the wall of which is imperforate, a pair of contact pin members 31 and 32 insulatively mounted on housing 30 by a plug member 33 of insulating material, and sealing means 34 for sealing the outer or left end of housing 30 to calbe $C_L$. Conductors 21 and 22 are connected to contact pin members 31 and 32, respectively, as will be explained later herein.

Referring to FIGS. 8-14, female subassembly F is shown as comprising a tubular metal female housing 35, a pair of socket members 36 and 37 insulatively mounted on housing 35 by a plug member 39 of insulating material, and sealing means 40 for sealing the outer or right end of housing 35 to cable $C_R$. Conductors 23 and 24 are connected electrically to socket members 36 and 37, respectively, as will be explained later herein.

Adverting to FIGS. 1-7, male housing 30 is shown as externally cylindrical and having an external tapered surface 41 as its inner or right end, a pair of external flat parallel surfaces 42, 42 on opposite sides at its outer or left end, and a length of external threads 43 intermediate its ends. Internally, housing 30 is shown as having a cylindrical bore 44 including a radially-enlarged left end section 45, a further enlarged inner or right end section 46, leaving an internal annular shoulder 47 therebetween, and an intermediate section 48 having a chordal wall surface 49. The body of housing 30 extends radially inwardly at opposite ends of chordal surface 49 to provide an inner or left radial surface 51 and an outer or right radial surface 52, the latter being coplanar with bore shoulder 47.

Figure 1:
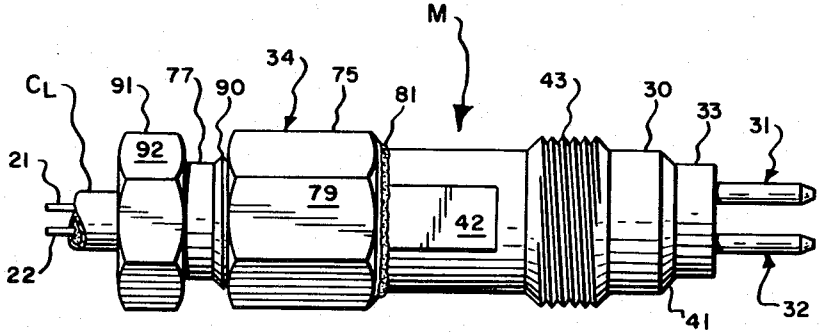
FIG. 1 is a top plan view of a male connector subassembly forming one part of a separable two-part connector embodying the present invention and preferred for connecting two mineral-insulated metal-sheath electrical cables of the same outside diameter and each containing two conductors.
Figure 2:
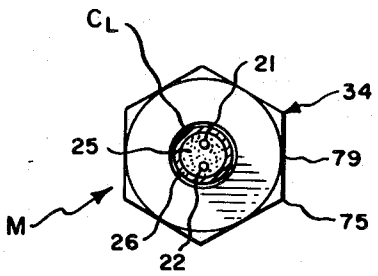
FIG. 2 is a left end view of such male subassembly and associated cable.
Figure 3:
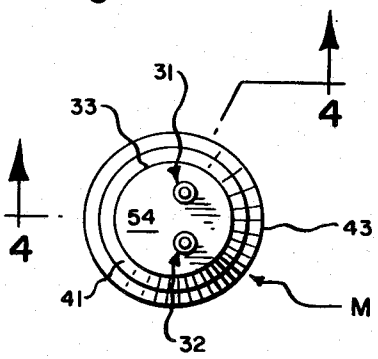
FIG. 3 is a right end view thereof.
Figure 6:
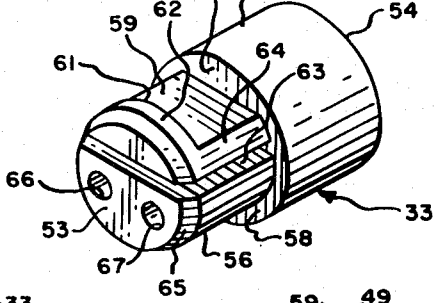
FIG. 6 is an enlarged perspective elevational view of the insulative plug shown in section in FIG. 4 and which is inserted into the right end of the housing of the male subassembly, this view looking at the left end of said plug which leads during its insertion.
Figure 5:
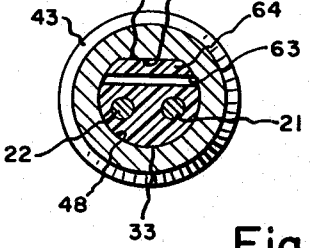
FIG. 5 is a transverse sectional view thereof taken on line 5—5 of FIG. 4.
Figure 4:
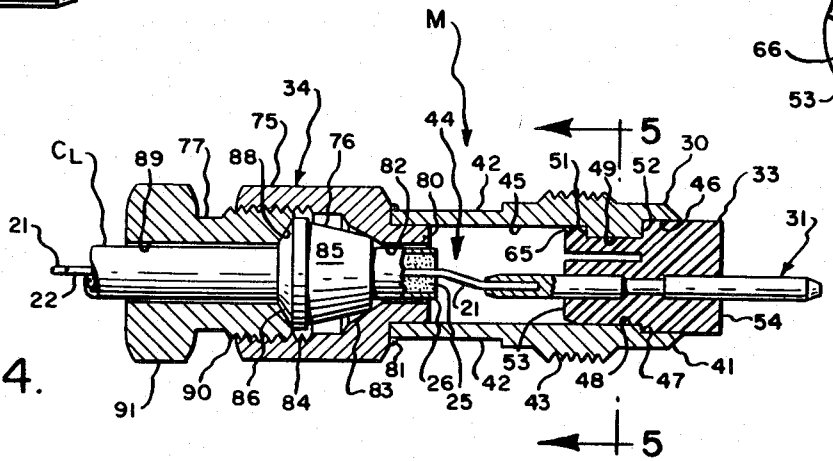
FIG. 4 is a longitudinal sectional view thereof taken generally on line 4—4 of FIG. 3, and showing the cable in elevation except for its inner or right end portion being broken away, and also showing the ferrule in elevation which surrounds the cable.

Plug 33 is a preformed body of insulating material insertable into the inner or right end of housing 30. As best shown in FIGS. 4 and 6, plug 33 has inner and outer end faces 53 and 54, respectively, between which it has an external peripheral shape conforming to the portion of bore 44 which it occupies when arranged in operative position in housing 30. More specifically, plug 33 has an enlarged cylindrical outer or right end portion 55, a cylindrical inner or left end portion 56, of reduced diameter leaving therebetween an annular shoulder 58. End portion 55 is shown as longer than counterbore 46 but has its cylindrical periphery complementary thereto. End portion 56 is shown as longer than the axial distance between radial surfaces 51 and 52, and has a chordal section of its cylindrical periphery removed so as to leave a flat chordal surface 59 having an axial length corresponding to said axial distance. The cylindrical periphery of left end portion 56 is complementary to the bore section 45, even as it continues into intermediate bore section 48. Chordal surface 49 and 59 are complementary. One radial end wall of the transverse groove which provides chordal surface 59 is coplanar with plug shoulder 58 as indicated at 60. The other end wall 61 extends radially outwardly and is arranged axially a short distance from left end face 53 to leave an abutment or lug 62.

Plug 33 is further provided with a chordal slot 63 generally parallel to chordal surface 59, opening to left end face 53 and having a depth terminating at about shoulder 60, thereby to provide a flexible tab 64. Abutment 62 is upstanding on the free end of this tab. Preferably, the outer annular corner of left plug portion 56 is beveled as indicated at 65, except where interrupted by slot 63, to facilitate insertion of the plug 33 into housing 30, as will be explained later herein.

Below slot 63 and radially offset from the axial centerline of plug 33, there are provided a pair of spaced holes 66, 67 which extend completely through the plug and open at opposite ends to end faces 53 and 54.

Contact pin member 31 is arranged in hole 66, and the other contact pin member 32 in hole 67.

Figure 7:
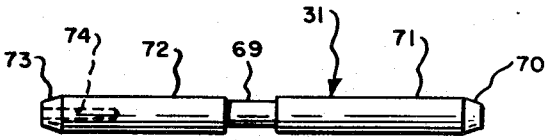
FIG. 7 is a side elevational view of the contact pin member carried by the insulative plug shown in FIG. 4.

Referring to FIGS. 4 and 7, details of contact pin member 31 are illustrated which is also representative of identical member 32. Member 31 is shown as being an elongated solid cylindrical metal member, about twice the length of plug 33, provided centrally with a relatively shallow but broad annular groove 69. One end portion has a beveled annular corner 70 to provide a prong or pin 71. The other end portion 72 is also beveled at its annular corner as indicated at 73, and provided with a cylindrical recess 74 for about half its length, adapted to receive the bared end of cable conductor 21 and secured by crimping, as explained later herein. Each pin member 31, 32 has an interference fit with the wall of its respective plug hole 66 or 67 so that when pressed thereinto and therethrough, the body of the plastic plug 33 will displace into and fill groove 69 and provide a mechanical interlock therebetween to hold the pin member against axial or longitudinal displacement relative to this plug. In some applications, the groove 69 may be eliminated and the friction resulting from a force fit of the pin member in the plug body can be relied upon to hold this member against displacement.

While any suitable means may be employed for sealing the outer or left end of male housing 30 to the left cable $C_L$, the means 34 are shown as including a seal body 75, ferrule 76 and seal cap 77. Body 75 has a hexagonal exterior surface 79 and includes a reduced cylindrical neck 80 at its right end which fits snugly into the left end of housing 30. Body 75 and housing 30 are sealingly secured together by an annular weldment indicated at 81. A passage extends completely through body 75 from end-to-end and is formed by a cylindrical right end section 82, an intermediate section having a leftwardly-enlarging tapered surface 83 and an enlarged cylindrical left portion provided with internal threads 84. Ferrule 76 is a metal ring having a control throughbore surrounding the metal sheath 26 of cable $C_L$ and constricted into sealing contact therewith, achieved by a right tapered external surface 85 engaging steeper tapered surface 83. The left end of ferrule 76 is steeply tapered reversely at 86 to be contacted by the correspondingly tapered right end 88 of seal cap 77. This cap has a central throughbore 89, a right portion with external threads 90 which screw into threads 84, and also has an enlarged head 91 at its left end provided with a hexagonal exterior surface 92. The walls of cap bore 89 and body bore 82 have a very slight clearance with metal sheath 26. By applying wrenches (not shown) to surfaces 79 and 92, it will be seen that seal cap 77 can be turned to move inwardly relative to seal body 75 and force ferrule 76 against tapered shoulder 83, thereby constricting the ferrule radially into sealing contact with cable sheath 26.

Male subassembly M is assembled in the following manner. To start with, seal cap 77 is loose on seal body 75 so that cable $C_L$ can be inserted and slid through this cap, ferrule and body to any desired extent. With plug 33 out of housing 30, the contact pin members 31 and 32 are pressfitted into this plug so that opposite end portions of these members project from the plug about equal amounts. The cable sheath 26 and mineral insulation 25 are cut back to expose equal lengths of cable conductors 21 and 22. The free ends of these conductors are then inserted into the recesses 74 of pin members 31 and 32, and then the surrounding portions of these members severally are crimped by a suitable tool (not shown), applying force from opposite sides to secure each member to its respective conductor. The crimping produces flats on the exterior of each member 31 and 32, one such flat being indicated at 93 in FIG. 15.

Thereafter, plug 33 is inserted into housing bore 44 from the right end thereof. As beveled corner 65 on the lead end of the plug begins to pass coplanar shoulder 47 and radial surface 52, tab 64 is cammed radially inwardly by flexing to close the outer portion of slot 63. This allows abutment 62 to slide under and axially along body chordal surface 49 until end wall 61 on this abutment is aligned with radial surface 51, whereupon tab 64 snaps radially outwardly to hook the abutment on this surface 51. In this position, the plug shoulder 58, 60 and housing shoulder 47, 52, and of course the chordal surfaces 49 and 59, are opposing and engaging each other. During insertion of plug 33, it will be angularly turned to align these chordal surfaces. It will be seen also that the offset of pin members 31 and 32 relative to cable $C_L$ will cause the exposed portions of the cable conductors to bend, as illustrated for conductor 21 in FIG. 4.

During this partial assembly, cable $C_L$ will have retrogressed or moved leftwardly through loose ferrule 85 and cap 77. Thereafter, this cap 77 is tighened to make ferrule 85 operative.

Adverting now to FIGS. 8–14, showing the female subassembly, tubular female housing 35, the wall of which is imperforate, has a stepped cylindrical exterior including an inner or left large section 95 and an outer or right smaller section 96, leaving an external annular shoulder 97 therebetween. Housing 35 also has a throughbore 98 including an inner or left large cylindrical section 99 and an outer or right smaller cylindrical section 100, leaving an internal annular shoulder 101 therebetween, and an intermediate section 102 having a chordal wall surface 103. The body of housing 35 extends radially inwardly at opposite ends of chordal surface 103 to provide an inner or right radial surface 104 and an outer or left radial surface 105, the latter being coplanar with bore shoulder 101.

The left end of female housing 35 has an internally tapered surface 106 adapted to be contacted by the externally tapered surface 41 on male housing 30. To force these tapered surfaces into firm sealing contact, female housing 35 carries a tubular coupling cap 108 shown as having a cylindrical exterior provided with flats 109, 109 on its opposite sides at its inner or right end, a stepped bore providing a leftwardly facing internal annular shoulder 110 adapted to engage external shoulder 97, and internal threads 111 at its open mouth or left end, these threads being adapted to screw onto threads 43 on male housing 30. The internal wall portion of cap 108 surrounding the tapered end portion 106 of housing 35 is relieved by the provision of an annular groove 112 to allow outwardly flaring of the left end portion of this housing, for a purpose explained more fully later herein.

The plug 39 is generally similar in construction to plug. Thus, plug 39 has an enlarged cylindrical outer or left end portion 113, a reduced cylindrical inner or right end portion 114, a transverse chordal groove providing a chordal bottom surface 115 and radial end walls 116 and 117, the latter being coplanar with an annular shoulder 118 between the stepped cylindrical portions, a beveled corner 120, a chordal slot 121 to provide a flexible tab 122 having an abutment or lug 123 at its free end, and a pair of spaced through holes 124 and 125.

These holes 124 and 125 receive socket members 36 and 37, respectively.

Figures 8, 9, 10, 11, 12, 13, 14:
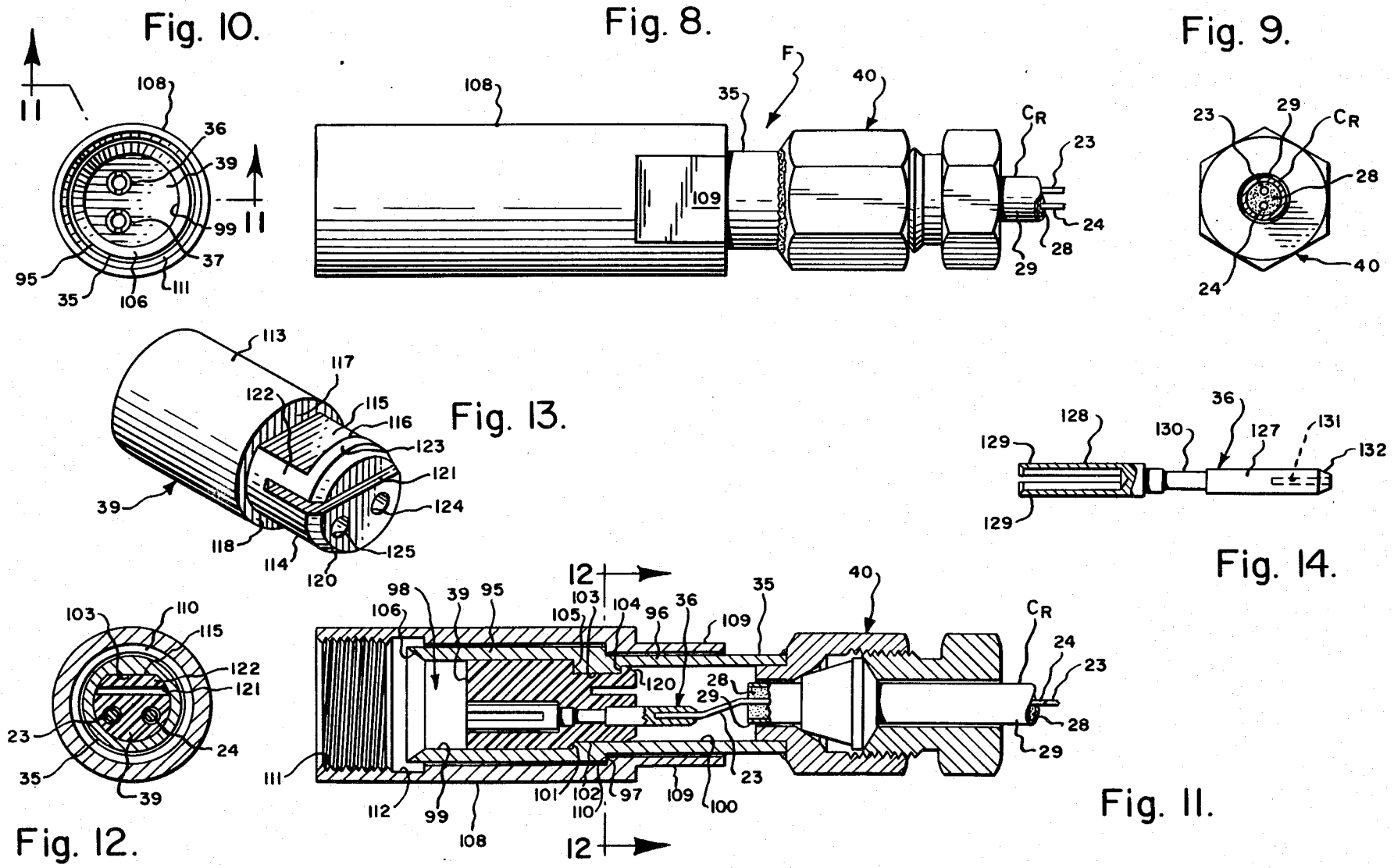
FIG. 8 is a top plan view of a female connector subassembly forming the other part of the inventive connector, and showing this subassembly associated with the other cable.
FIG. 9 is a right end view of such female subassembly with its associated cable.
FIG. 10 is a left end view thereof.
FIG. 11 is a longitudinal sectional view thereof taken generally on line 11—11 of FIG. 10, and showing the cable in elevation except for its inner or left end portion being broken away, and also showing the ferrule in elevation which surrounds the cable.
FIG. 12 is a transverse sectional view thereof taken on line 12—12 of FIG. 11.
FIG. 13 is an enlarged perspective elevational view of the insulative plug shown in section in FIG. 11 and which is inserted into the left end of the housing of the female subassembly, this view looking at the right end of said plug which leads during its insertion.
FIG. 14 is a side elevational view of the socket member carried by the insulative plug shown in FIG. 11.

Referring to FIGS. 11 and 14, details of socket member 36 are illustrated which is also representative of identical member 37. Member 36 is shown as including an elongated solid cylindrical metal rod part 127 and an enlarged cylindrical socket part 128, the latter being tubular and split diametrically to provide curved segmental fingers 129, 129. Rod part 127 adjacent socket part 128 is provided with a shallow relatively broad external annular groove 130. The free end of rod part 127 has a central axial recess 131 to receive cable conductor 23, and a beveled corner 132. Plug holes 124 and 125 are counterbored to receive the enlarged socket part 128 of its corresponding socket member and have a slight clearance so fingers 129 can spread.

As explained previously for the contact pin members, the groove 130 in the socket member may be eliminated in some applications so that the fricitional hold of the plug body of the socket member may be relied upon to prevent relative displacement.

Sealing means 40 are identical to the means 34 and hence the detailed description of the same will not be repeated.

Female subassembly F is assembled in a manner generally similar to that described for male subassembly M. Thus, initially, the seal cap is backed up on the threads of the seal body of means 40 to allow cable $C_R$ to pass through the ferrule, the end of this cable being cut back to expose bare end portions of conductors 23 and 24. Socket members 36 and 37 are pressfitted into holes 124 and 125 of plug 39, from left to right as viewed in FIG. 11. The interference fit of rod port 127 in the plug hole causes flow of insulating material of plug 33 into groove 130 and provides a mechanical interlock, as previously explained. The bared ends of the cable conductors are inserted into their respective recesses 121 and secured by crimping to provide flats on rod part 127 such as illustrated at 133 in FIG. 15. Next, the plug 39 is inserted into the enlarged left bore section 100 of female housing 35, and this plug snaps into final latched position, as previously described for plug 33. The seal cap of means 40 is then tightened to squeeze the ferrule into sealing contact with cable $C_R$.

The male and female subassemblies M and F are then joined by inserting contact pin members 31 and 32 into socket members 36 and 37, respectively, and screwing coupling cap 108 onto threads 43, as shown in FIG. 15. This draws the subassemblies together and forces tapered surfaces 41 and 106 into firm contact with each other. Each of these tapered surfaces has a smoothness rating of 32 RMS or better. Put another way, since it is known to the skilled artizan that RMS means 'root mean square' and an RMS number is indicative of the average depth of the valleys between peaks in a surface which is not perfectly planar, the lower the RMS number the less likelihood of deeper valleys and the better the quality of surface. Accordingly, a surface rated at 32 RMS or better, means an RMS rating number no higher than 32. Also, the taper of male surface 41 is at a steeper angle, such as 40 degrees, than the taper of female surface 106, which may be 37 degrees, and preferably the difference in the angles of the tapers is 3 degrees. This assures effective metal-to-metal sealing contact. Coupling cap 108 is tightened by applying a holding wrench (not shown) to flats 42, 42 on male housing 30, and a turning wrench (not shown) to flats 109, 109 on this cap. At this cap is tightened male tapered surface 41 will tend to flare radially outwardly female tapered surface 106. This flaring tendency is accommodated by the relieved portion 112 of cap 108 and also assures the maintenance of a forceful engagement of tapered surfaces 41 and 106 due to the elasticity of the metal of which female housing 35 is composed, which is typically stainless steel. Thus, the portion of the tubular wall of the female housing surrounding its internal tapered surface is externally unrestrained and has a thickness to permit an outward flaring of such wall when the external tapered surface on the male housing is forced against such internal tapered surface.

It will also be noted that the prongs 71 of contact pin members 31 and 32 are slightly larger in outside diameter than the collective inside diameter of fingers 129, 129 of socket members 36 and 37 so that when these prongs penetrate the space between these fingers the latter are spread slightly. Because of their inherent springiness these fingers 129 maintain a firm and electrically conductive contact with prongs 71.

It will also be noted that since contact pin members 31 and 32 are eccentric to the central longitudinal axis of male housing 30, as are socket members 36 and 37 with respect to the central longitudinal axis of female housing 35 and to the same extent, a polarized connector is provided. This is important in order to put the correct contact pin members 31 and 32 into contact with the appropriate socket members 36 and 37. For example, if left cable $C_L$ is a thermocouple its conductors 21 and 22 may be made of chromel and alumel, respectively, and the associated mating contact pin members 31 and 32 and socket members 36 and 37, the associated conductors 23 and 24 of right cable $C_R$, are also made of chromel and alumel. As is well known, the subjection of the junction (not shown) of two dissimilar metals to a temperature will generate a potential related to the temperature sensed. Instead of the aforementioned combination of two dissimilar metals, the combination of chromel and constantan, or iron constantan, or copper and constantan, may be used. In short, one of the two sets of connected conductors, and pin and socket members is made of the same metal, and the other set is made of the same but different metal.

In the case of a resistance temperature device (RTD) which, as is well known, includes a platinum wire coil (not shown), the resistance of which changes in proportion to temperature, the conductors of cables $C_L$ and $C_R$, contact pin members 31 and 32 and socket members 36 and 37, all may be made of copper or copper alloy and either plated.

If it is desired to disconnect male and female subassemblies M and F, respectively, coupling cap 108 is unscrewed from threads 43, allowing these subassemblies to be separated by withdrawing the prongs of contact pin members 31 and 32 from the respective sockets of socket members 36 and 37. This provides a quick disconnect connector.

Further, it is to be noted that each of the insulating plugs 33 and 39 holds its corresponding members 31, 32 or 36, 37 against longitudinal movement relative thereto and out of contact with the corresponding housing 30 or 35. As well, each of the insulating plugs 33 and 39, by reason of being held against longitudinal and angular movement relative to its corresponding housing 30 or 35, holds its corresponding members 31, 32 or 36, 37 against longitudinal and angular movement relative to its corresponding housing 30 or 35. While plugs 33 and 39 may be made of any suitable insulating material, it is preferred to construct them of polysulfone.

FIG. 16

Figure 16:
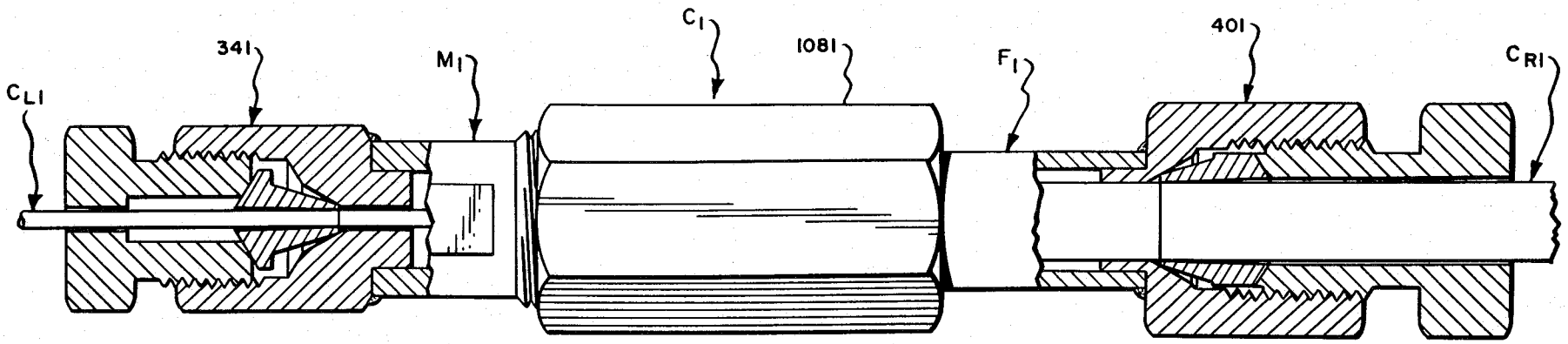
FIG. 16 is a longitudinal view of connected male and female subassemblies of generally similar construction to those shown in FIG. 15, but providing a connector embodying a first modified form of the invention for connecting two mineral-insulated metal-sheath cables of different outside diameters, the larger cable being at the right, showing longitudinal central sectional views of the means for sealing the outer ends of the male and female housings to their respective associated cables, and also showing in elevation the modified cap coupling the housings.
Figures 17, 18, 19, 20:
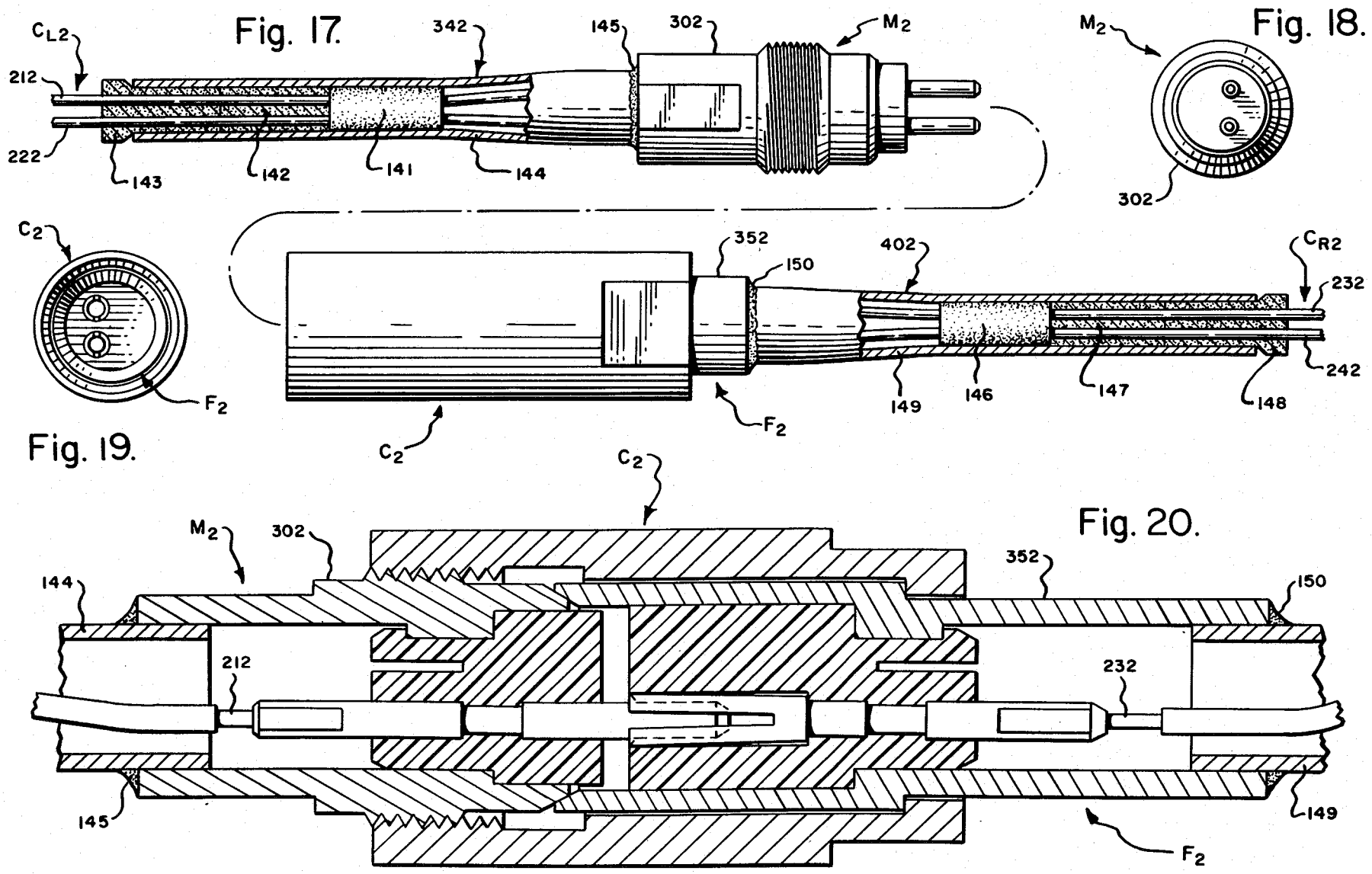
FIG. 17 is a longitudinal elevational view of separated male and female subassemblies providing a connector embodying a second modified form of the invention for connecting two pairs of insulated conductors, and showing mechanically reduced metal extensions of the male and female housings partially broken away to reveal in section means different from those previously illustrated for sealing the outer ends of the male and female housings to their respective associated pair of conductors.
FIG. 18 is a right end view of the male subassembly shown in FIG. 17.
FIG. 19 is a left end view of the female subassembly shown in FIG. 17.
FIG. 20 is an enlarged longitudinal sectional view generally similar to FIG. 15, but taken through the male and female subassemblies shown in FIG. 17 when connected together.

The modification shown in FIG. 16 is intended to illustrate the inventive connector $C_1$ connecting a smaller left mineral-insulated metal-sheath cable $C_{L1}$ of a male subassembly $M_1$, to a larger right mineral-insulated metal-sheath cable $C_{R1}$ of a female subassembly $F_1$, as compared to the cables $C_L$ and $C_R$ shown in FIGS. 1 to 8 which have the same outside diameter. The principal change is in the dimensioning of the elements of seal means 341 and 401 to accommodate the particular outside diameters of cables $C_{L1}$ and $C_{R1}$. One further difference is shown, and that is the external shape of the modified coupling cap 1081 which is hexagonal. Otherwise subassemblies $M_1$ and $F_1$ are similar to subassemblies M and F shown in FIGS. 1 and 8.

FIGS. 17–20

The modification shown in FIGS. 17–20 is intended to illustrate the inventive connector $C_2$ having modified male and female subassemblies $M_2$ and $F_2$, respectively, for connecting plastic covered conductors of cables $C_{L2}$ and $C_{R2}$ and necessitating modified seal means 342 and 402.

Subassemblies $M_2$ and $F_2$ differ from the corresponding subassemblies M and F previously described, only in the details of the seal means 342 and 402 to adapt them for sealing cables $C_{L2}$ and $C_{R2}$, respectively.

Left cable $C_{L2}$, like the other cables, is shown as having two conductors 212 and 222, severally encased in an insulative coating, which pass through separated holes in each of several contactingbodies of sealant material three such bodies being shown at 141, 142 and 143, swaged in a metal tubing 144. The inner or right end of tubing 144, preferably made of stainless steel, is shown welded to male housing member 302 at 145. The sealant bodies 141–143 are compressed around conductors 212 and 222 and within tubing 144. This arrangement provides an effective seal.

Similarly, right cable $C_{R2}$ is shown as having two conductors 232 and 242, severally encased in an insulative coating, and passing through separated holes in three contiguous sealant bodies 146, 147 and 148, swaged in a metal tubing 149. The inner or left end of tubing 149 is shown welded to male housing member 352 at 150.

While not illustrated specifically, it is apparent that a mineral-insulated metal sheath cable may be connected by the inventive connector to a plastic insulated cable. In all combinations of cables, the inventive connector provides a quick disconnect, metal-to-metal seal which is highly effective.

As used herein, a pair of electrical cables expresses the minimum usefulness of the inventive connector in connecting at least one cable on one side of the connector to at least one cable on the other side of the connector. In other words, there may be more than one cable on each side of the connector, whether the same number on each side or a greater number on one side of the connector than on the other. Where there is more than one cable on one side of the conductor, their conductors may be connected in parallel or some other circuit arrangement to either the contact pin members or socket members on the corresponding side of the connector.

Other variations and modifications in the illustrated embodiments of the inventive connector may occur to those skilled in the art without departing from the spirit of the present invention, the scope of which is to be measured by the appended claims.

What is claimed is:

1. A connector for sealingly joining the ends of a pair of electrical cables, each of said cables having at least one insulated conductor, comprising:

(a) a tubular metal male housing having inner and outer ends and encircling a marginal end portion of one of said cables, (b) an externally-tapered surface on said inner end of said male housing, (c) a tubular metal female housing having inner and outer ends and encircling a marginal end portion of the other of said cables, (d) an internally-tapered surface on said inner end of said female housing and adapted to be contacted by said externally-tapered surface, the taper of said externally tapered surface being at a steeper angle than the taper of said internally tapered surface, and the quality of finish of such tapered surface having an RMS rating number no higher than 32, (e) means arranged to draw said housings together and force said tapered surfaces into firm contact to provide a sealing metal-to-metal joint therebetween, (f) a contact pin member insulatively mounted in one of said housings and electrically connected to the conductor in the cable associated with such housing, (g) a socket member insulatively mounted in the other of said housings and electrically connected to the conductor in the cable associated with such housing and adapted to receive said pin member, and (h) means sealing the outer end of each of said housings to its associated cables, thereby to form a sealed chamber within said joined housings within which electrical contact may be made.

2. A connector according to claim 1 wherein the difference in the angles of the tapes is 3 degrees.

3. A connector according to claim 1 wherein the portion of said tubular wall of said female housing surrounding said internally-tapered surface is externally unrestrained and has a thickness to permit an outward flaring of such wall when said externally-tapered surface is forced against said internally-tapered surface.

4. A connector according to claim 1 wherein at least one of said cables is a mineral-insulated metal-sheath cable, and the outer sealing means therefor includes a seal body secured to the corresponding housing and having an internally-tapered cam surface surrounding such cable sheath, a metal ferrule surrounding said sheath and having an externally-tapered cam surface engaging said internally-tapered cam surface, and a cap surrounding said sheath and having a threaded connection with said seal body for forcing said ferrule against said internally-tapered cam surface and into constrictive sealing contact with said sheath.

5. A connector according to claim 1 wherein at least one of said cables comprises at least one plastic covered conductor, and the outer sealing means for such one of said cables includes a swaged assembly of displaceable sealant bodies compressed around such conductor and encased in a metal casing, one end of which is sealingly secured to the associated housing.

6. A connector according to claim 1 wherein each of said housings has a bore including an intermediate section having a chordal wall surface, said intermediate section separating an enlarged section on one side thereof from a further-enlarged section on the other side thereof, said enlarged section opening to said one end of such housing, said connector further comprising an insertable preformed body of insulating material plugging said bore of each of said housings at one end thereof, each of said bodies having inner and outer end faces between which it has an external peripheral shape conforming to the internal shape of said intermediate section for the full axial length thereof and also conforming to that of the walls of each of said enlarged and further-enlarged sections for at least part of the length thereof, having a chordal slot generally parallel to said chordal wall and opening to said inner end face to provide a flexible tab having an outstanding abutment at its free end, said tab bending to close said slot to allow passage of said abutment through said intermediate section during insertion of the body into the associated housing but bending to open said slot when said abutment has passed through said intermediate section and is arranged within said enlarged section, thereby to latch said body against longitudinal withdrawal while it is prevented from angular movement relative to the housing which surrounds it by the opposing chrodal surfaces thereon, said contact pin member being carried by one of said bodies, and said socket member being carried by the other of said bodies.

* * * * *

UNITED STATES PATENT AND TRADEMARK OFFICE

CERTIFICATE OF CORRECTION

PATENT NO. : 4,618,198

DATED : October 21, 1986

INVENTOR(S) : Steven M. Dale, Richard A. Lyon, David P. Schutrum

It is certified that error appears in the above—identified patent and that said Letters Patent is hereby corrected as shown below:

In the listing of the Inventors [75] on the first page of the patent, change "David P. Schutram" to — David P. Schutrum —.

On line 3 of the ABSTRACT [57] on the first page of the patent, change ".Without" to — , without —.

In claim 2, column 10, line 41, change "tapes" to — tapers —.

Signed and Sealed this

Fourteenth Day of April, 1987

*Attest:*

DONALD J. QUIGG

*Attesting Officer*

*Commissioner of Patents and Trademarks*